US006305623B1

(12) United States Patent
Sotsky et al.

(10) Patent No.: US 6,305,623 B1
(45) Date of Patent: Oct. 23, 2001

(54) ROTARY GRINDER WITH IMPROVED RAM AND SCREEN

(75) Inventors: George R. Sotsky; Kenneth W. King, both of Louisville, KY (US)

(73) Assignee: Republic Welding Company, Louisville, KY (US)

( * ) Notice: Subject to any disclaimer, the term of this patent is extended or adjusted under 35 U.S.C. 154(b) by 0 days.

(21) Appl. No.: 09/375,978

(22) Filed: Aug. 16, 1999

Related U.S. Application Data

(60) Provisional application No. 60/097,154, filed on Aug. 19, 1998.

(51) Int. Cl.[7] ..... B02C 18/08
(52) U.S. Cl. ..... 241/73; 241/243; 241/280
(58) Field of Search ..... 241/73, 243, 280, 241/281, 282

(56) References Cited

U.S. PATENT DOCUMENTS 3,891,152 * 6/1975 Guggenheimer ..... 241/88.4
4,844,363 * 7/1989 Garnier et al. ..... 241/224
5,005,614 * 4/1991 Rossler ..... 241/73
5,062,575 * 11/1991 Barnabie et al. ..... 241/73
5,344,088 * 9/1994 Page ..... 241/282
5,509,613 * 4/1996 Page ..... 241/282
5,628,467 * 5/1997 Graveman ..... 241/88.4
5,645,234 * 7/1997 Zotto ..... 241/101.76

* cited by examiner

*Primary Examiner*—John M. Husar
(74) *Attorney, Agent, or Firm*—James C. Eaves, Jr.; Greenebaum Doll & McDonald PLLC

(57) ABSTRACT

The present invention relates to a rotary grinder with an improved ram and screen. Rotary grinders of the present invention are, for example, used to grind plastic or wood to reduce the size of the material to a desired size. Material to be ground is placed inside a hopper and a ram is used to force the material toward the rotor having a plurality of cutters thereon. The ram does not have to ride in horizontal channels on the sides of the hopper so material does not interfere with or jam the ram. Further, a grooved screen may be employed wherein the screen has a plurality of V-shaped grooves therein in which the cutters travel. This permits the cutters to "clean" the screen so that ground material, for example, plastic, does not block the openings in the screen.

16 Claims, 20 Drawing Sheets

ROTARY GRINDER WITH IMPROVED RAM AND SCREEN

This application claims benefit of Ptov. No. 60/097,154 filed Aug. 19, 1998.

BACKGROUND OF THE INVENTION

1. Field of the Invention

The present invention relates to a rotary grinder with an improved ram and screen. Rotary grinders of the present invention are, for example, used to grind plastic or wood to reduce the size of the material to a desired size. Material to be ground is placed inside a hopper and a ram is used to force the material toward the rotor having a plurality of cutters thereon. The ram does not have to ride in horizontal channels on the sides of the hopper so material does not interfere with or jam the ram. Further, a grooved screen may be employed wherein the screen has a plurality of V-shaped grooves therein in which the cutters travel. This permits the cutters to "clean" the screen so that ground material, for example, plastic, does not block the openings in the screen.

2. Discussion of the Prior Art

Rotary grinders with forced horizontal feed are known, such as, for example, the ReTech Model RG-52 Rotary Grinder, wherein the ram compartment lower portion of the hopper of the grinder contains a pair of horizontal channels or grooves on the opposed sides of the hopper. A ram, typically horizontally driven by a hydraulic piston system, has its top plate or deck slidably received in the two opposed grooves, which are lined with a plastic bearing material, to reduce friction and prevent metal to metal contact. If a heavy load is dropped on top the ram during its travel, the large bearing surface of the grooves stabilize against the impact. A disadvantage of these grooves is that they are exposed on the inside of the hopper compartment and, as a result, can be jammed with small material which is to be ground. This can cause wear or failure of the plastic guide rails and can jam the ram and prevent horizontal movement of the ram. The long channels can also affect the strength of the hopper, as the channels traverse along most of the horizontal length of both sides of the hopper.

This channel system provides little or no stabilization in the vertical plane and result in rollers being added to the back side of the ram to improve this stability. However, because of the manufacture, additional clearance is provided between the periphery of the ram and the ram compartment and, therefore, the necessity of an elaborate seal system to close the gap.

In grinders such as the ReTech Model RG-52 Rotary Grinder, an arced screen is spaced from the rotor containing a plurality of cutters attached thereto. One grinder may have a plurality of screens, each with a different size openings therethrough. A screen with desired size openings is selected and positioned after the rotor. Only material which has been ground down to a sufficient size to pass through the screen openings will exit the grinder onto a conveyor or container. Ground material which is too large to pass through the screen openings will be reground to a smaller size. When grinding certain plastic, it has been found that the plastic will not pass completely through the screen openings but, instead, hangs up in the openings and results in a blockage of the screen openings and requires shutting down of the grinder to clear the plastic material from the screen openings.

German patent reference no. 3,932,345 teaches a typical rotor and cutters. U.S. Pat. No. 4,844,363 teaches a non-horizontal moving hopper ram wherein the ram is guided by a pair of grooved tracks 49. U.S. Pat. Nos. 5,509,613 and 5,344,088 teach material grinders having a ram driven by a pair of pistons 24 from hydraulic cylinders 23. U.S. Pat. No. 5,645,234 teaches another grinder having a ram head 50.

SUMMARY OF THE INVENTION

The present invention is for a rotary grinder with an improved ram and screen. Rotary grinders of the present invention are, for example, used to grind plastic or wood to reduce the size of the material to a desired size. Material to be ground is placed inside a hopper and a ram is used to force the material toward the rotor having a plurality of cutters thereon. The ram does not have to ride in horizontal channels on the sides of the hopper so material does not interfere with or jam the ram. Further, a grooved screen may be employed wherein the screen has a plurality of V-shaped grooves therein in which the cutters travel. This permits the cutters to "clean" the screen so that ground material, for example, plastic, does not block the openings in the screen.

The grinder of the present invention eliminates the horizontal channels which guide the ram. The ram system of the present invention employs a linear bearing system which is mounted remotely under the ram compartment. The linear bearing system is connected to the ram assembly with U-shaped brackets which allows the ram to operate above the linear bearing system with the floor of the ram compartment in between. While still driven by an hydraulic piston and cylinder system, the ram is guided in the horizontal direction by a center horizontal shaft member of circular cross-section.

The ram guide system of the instant invention has several advantages over other known rams. First, the ram guide system employs a reasonably frictionless dry slide bearing system impervious to product grit and particles since it is mounted remotely, since it uses no lubrication, and since it employs a hardened and ground bearing path combined with low friction bearing material. Second, it provides close tolerance stability in both the vertical and horizontal planes as the ram moves horizontally, resulting in smaller clearance requirements between the periphery of the front ram plates and the ram compartment. This results in less sophisticated product sealing system between the ram and compartment walls. Third, there are no exposed guide grooves in the ram compartment, so there can be no jamming of the ram in its horizontal movement due to product. Fourth, the quick wearing plastic bearing channels or grooves are replaced with a longer life sealed dry slide hardened race bearing system. Fifth, the need for numerous rollers to stabilize the ram in the vertical plane is eliminated. Sixth, there is less friction during ram horizontal travel, so less energy is required. Seventh, by connecting the linear bearing system with U-shaped brackets permits the bearing system to extend under the a compartment floor as opposed to having to extend from the rear of the grinder, thereby resulting in a more dimensionally compact grinder.

BRIEF DESCRIPTION OF THE DRAWINGS

A better understanding of the invention will be had upon reference to the following description in conjunction with the accompanying drawings in which like numerals refer to like parts and wherein.

DETAILED DESCRIPTION OF THE PREFERRED EMBODIMENT

FIGS. 1–9show various view of the ReTech Model RG-52 Rotary Grinder. For the instant invention, the ram assembly and the screen have been changed, as explained herein. The following is a list of the part numbers referred to in FIGS. 1–9, and particularly in FIGS. 5 and 7–9:

| Part No. | Description |
|---|---|
| 1 | Counter Knife-Left |
| 1A | Counter Knife-Right |
| 2 | Rotor |
| 2A | Cutter Insert Assembly |
| 2B | Cutter |
| 3 | Key |
| 4 | Spacer |
| 5 | Floating Bearing |
| 6 | Fixed Bearing |
| 7 | Seal Flange |
| 7A | Felt Seal |
| 8 | Access Plates |
| 9 | Gear Box |
| 10 | Gear Box Sheave |
| 11 | Torque Compensation Arm |
| 12 | Main Drive Motor |
| 13 | Main Drive Motor Sheave |
| 14 | Fluid Coupling |
| 15 | Vibration Bushing |
| 16 | Torque Spring Assembly |
| 17 | Torque Spring Cylinder |
| 17A | Torque Spring Cylinder Hardware Kit |
| 17B | Torque Limiting Switch |
| 17C | Vibration Bushing Pin Kit |
| 18 | Drive Belt |
| 19 | Upper Wiper Plate |
| 20 | Upper Wiper |
| 21 | Bottom Wiper Plate |
| 22 | Bottom Wiper |
| 23 | Side Wiper |
| 24 | Pressure Spring |
| 25 | Tension Spring |
| 26 | Fender Washer |
| 27 | Regular ½" -13-Hex Nut |
| 28 | Elastic Lock Nut |
| 29 | Plastic Guide Rail |
| 30 | ⅜"-16 × 2¼" Bolt |
| 31 | ⅜" Star Washer |
| 32 | ⅜"-16-Hex Nut |
| 33 | Ram Plate |
| 34 | Cam Follower |
| 35 | Eccentric Bushing |
| 36 | Straight Bushing |
| 37 | Flat Washer |
| 38 | Belleville Disk Washer |
| 39 | ⅝"-11 × 4" (Grade 8) Socket Head Cap Screw |
| 40 | Cover Latch |
| 41 | Machine Guard |
| 42 | Motor Ventilation Screen |
| 43 | ¼" Flat Mounting Washer |
| 44 | ¼"-20 × ½" Button Head Screw |
| 45 | Rotor Screen |
| 46 | ⅝"-11 × 1¼" Socket Head Cap Screw |
| 47 | ⅝" Flat Washer |
| 48 | Hydraulic Cross Bar |
| 49 | ⅝"-11 Hex Head Bolt |
| 5o | ⅝" Star Washer |
| 51 | Hydraulic Trunnion Block |
| 52 | Hydraulic Eye Pin |
| 53 | Snap Ring |
| 54 | Hydraulic Cylinder |
| 55 | ½" Hydraulic Formed Tube |
| 56 | ½" Hydraulic Formed Tube |
| 57 | 24" Hydraulic Hose |
| 58 | 27" ½" diameter Hydraulic Tube |
| 59 | 18" Hydraulic Hose |
| 60 | 36" Hydraulic Hose |
| 61 | Hydraulic Block |
| 62 | 90° Hydraulic Fitting |
| 63 | Straight Hydraulic Coupling |
| 64 | ½" Pipe Clamp |
| 65 | Tube Support Bracket |
| 66 | Hydraulic Reservoir |
| 67 | Filler Cap |

-continued

| Part No. | Description |
|---|---|
| 68 | Sight Glass |
| 69 | Flange Gasket |
| 70 | Pressure Switch |
| 71 | Pressure Switch Tube |
| 72 | Switching Valve |
| 73 | Straight Coupling |
| 74 | Strainer Tube |
| 75 | Strainer Screen |
| 76 | Hydraulic Motor |
| 77 | Hydraulic Pump |
| 78 | Coupling |
| 79 | Pressure Gage Block |
| 80 | 90° Pressure Fitting |
| 81 | Pressure Gage |
| 82 | Straight Fitting |
| 83 | ½" Formed Tubing |
| 84 | ¾" Formed Tubing |
| 85 | 90° Fitting |
| 86 | Hydraulic Oil Filter |
| 87 | Oil Filter Fitting |
| 88 | 90° Fitting |
| 89 | Straight Fitting |
| 90 | Housing |
| 91 | Guide Rail Slots |
| 92 | Ram compartment |

Figure 1:
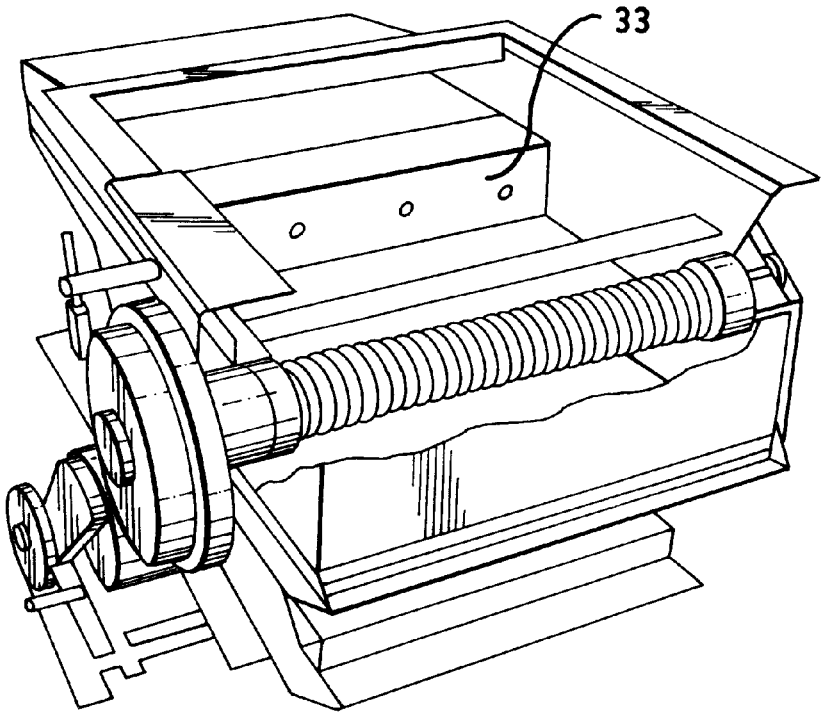
FIG. 1 (PRIOR ART)
FIG. 1 is a perspective view of the prior art ReTech Model RG 52 rotary grinder.
Figure 2:
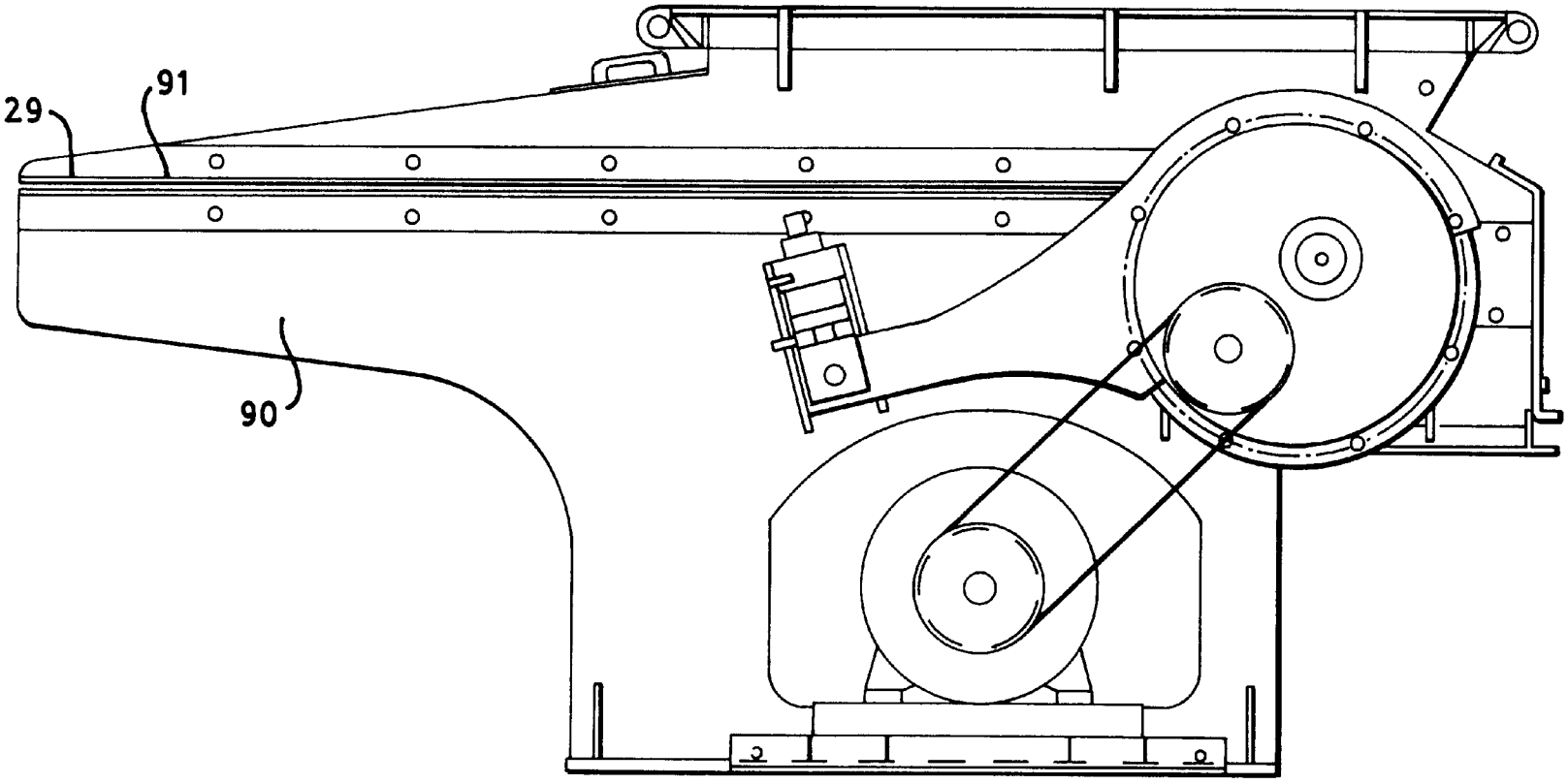
FIG. 2 (PRIOR ART)
FIG. 2 is a side view of the grinder of FIG. 1.
Figure 3:
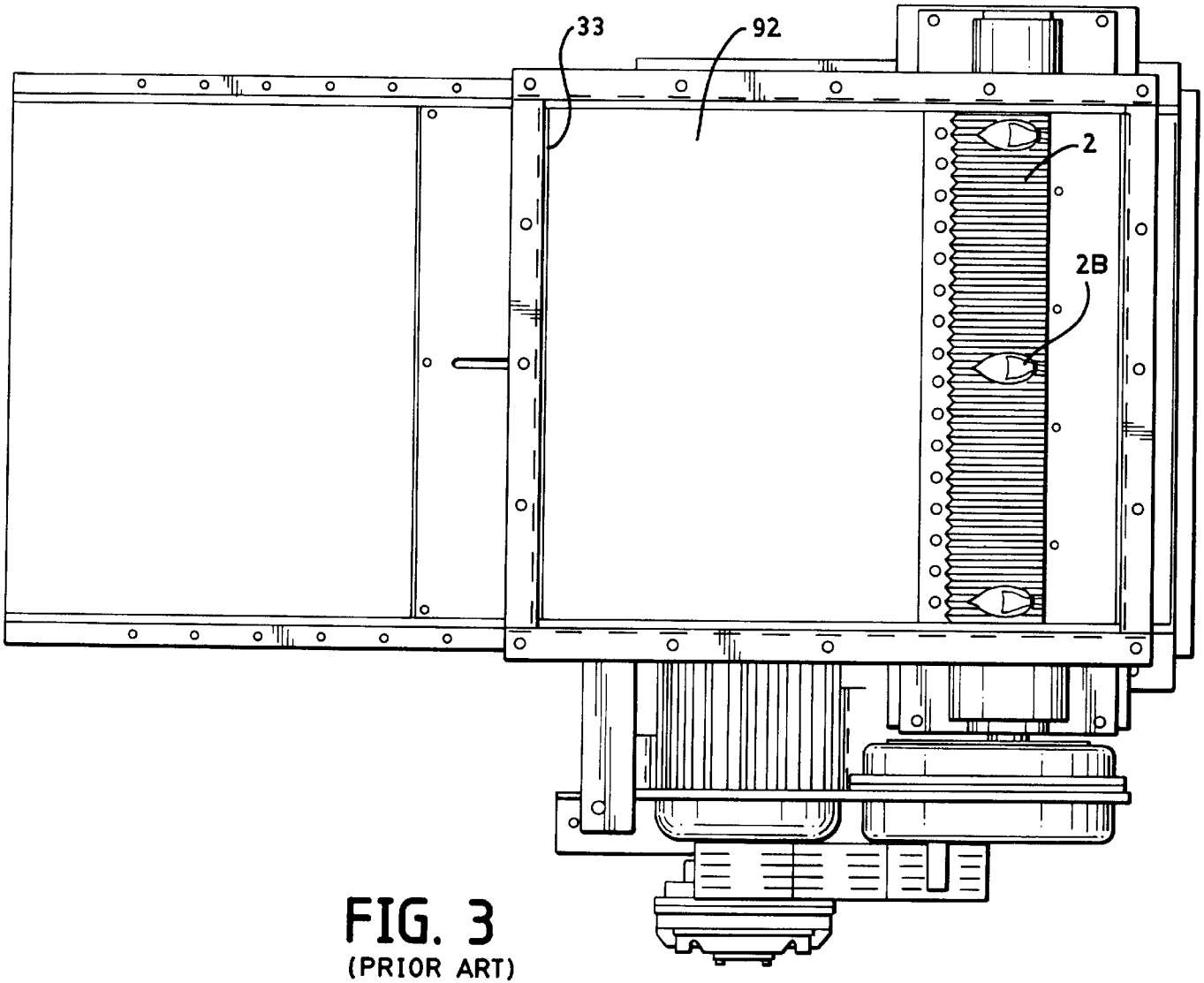
FIG. 3 (PRIOR ART)
FIG. 3 is a top view of the grinder of FIG. 1.
Figure 4:
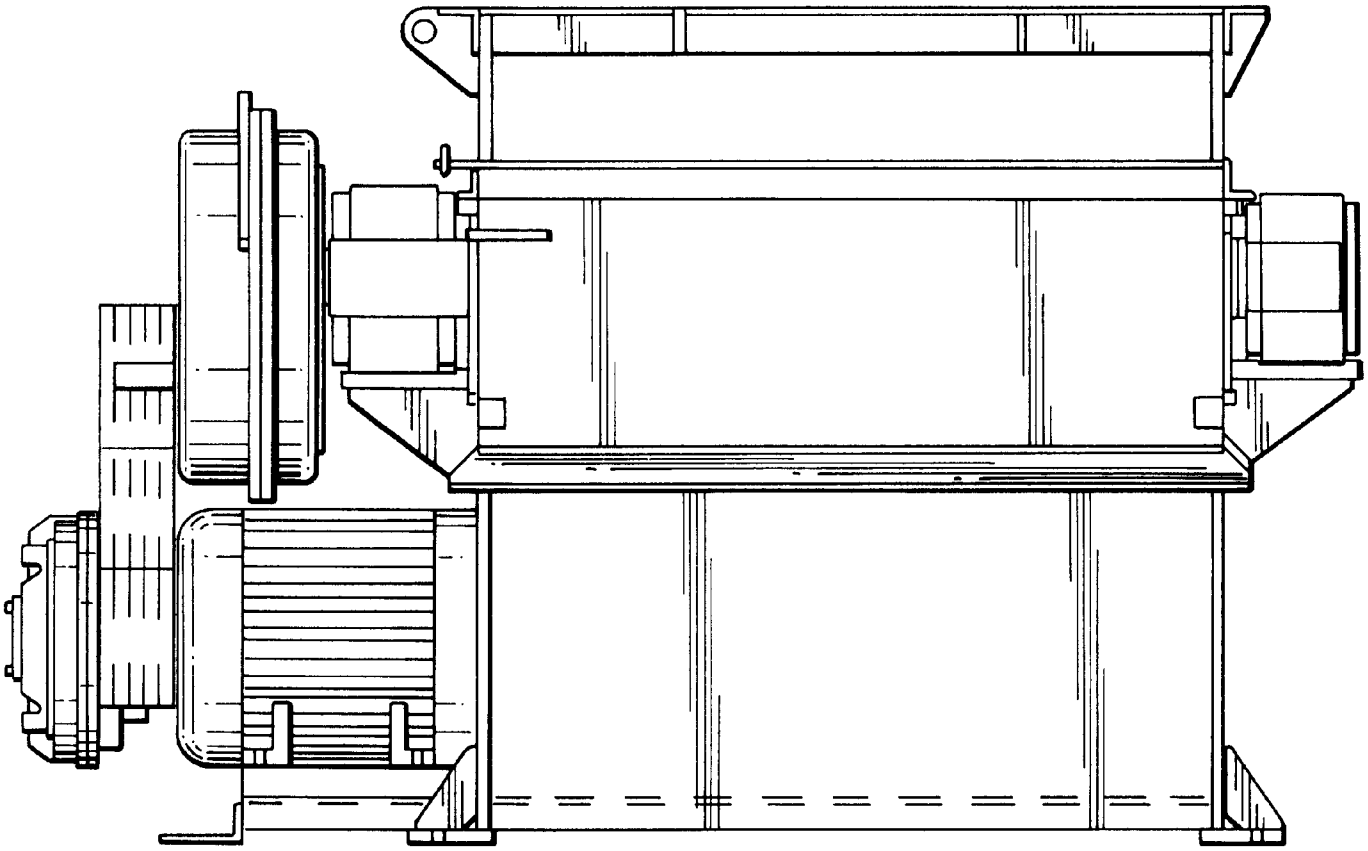
FIG. 4 (PRIOR ART)
FIG. 4 is an end view of the grinder of FIG. 1.
Figure 5:
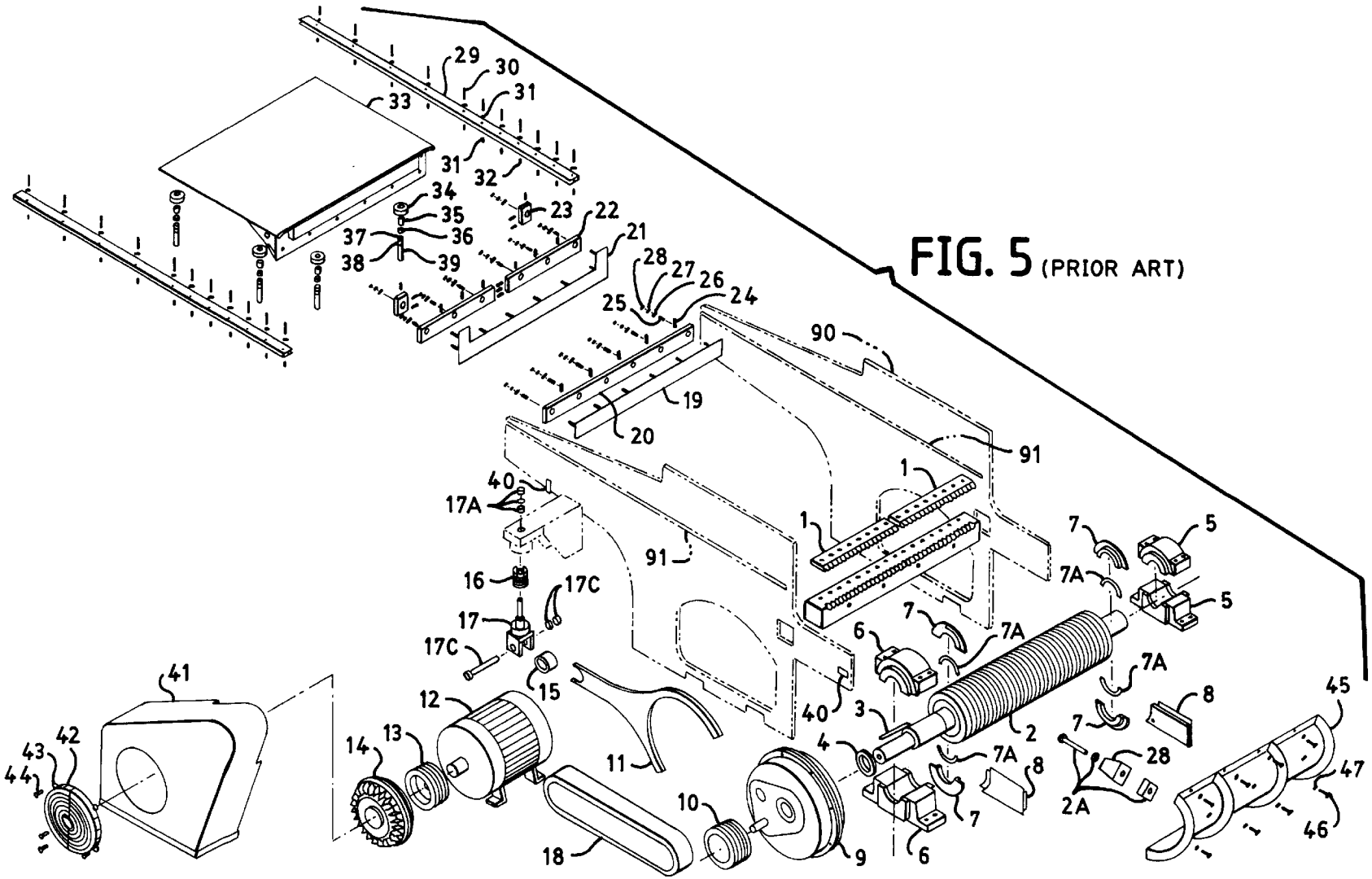
FIG. 5 (PRIOR ART)
FIG. 5 is an exploded perspective view of the grinder of FIG. 1.
Figure 6:
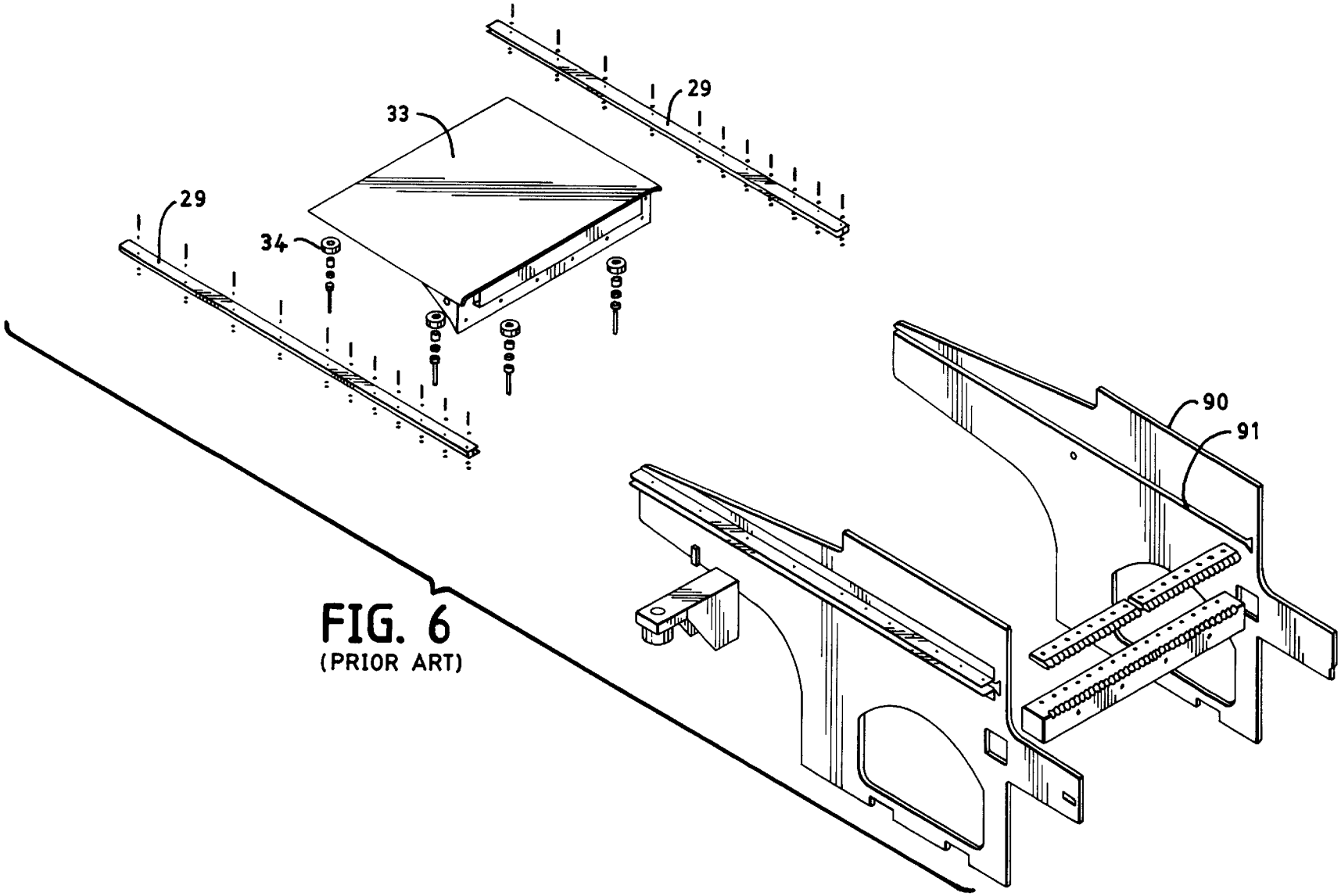
FIG. 6 (PRIOR ART)
FIG. 6 is an enlarged exploded perspective view of the grooved plastic bearing inserts, ram, and housing of the grinder of FIG. 1, with exploded detail of the groove and the grooved plastic bearing inserts which are inserted into slots which are cut into the side walls of the machine and which stabilize the ram in the horizontal plane as the edges of the ram plate are received in and slide in the groove, the horizontal motion being powered by hydraulic cylinders, the figure also showing the roller assemblies 34–39 which stabilize the ram in the vertical plane.
Figure 7:
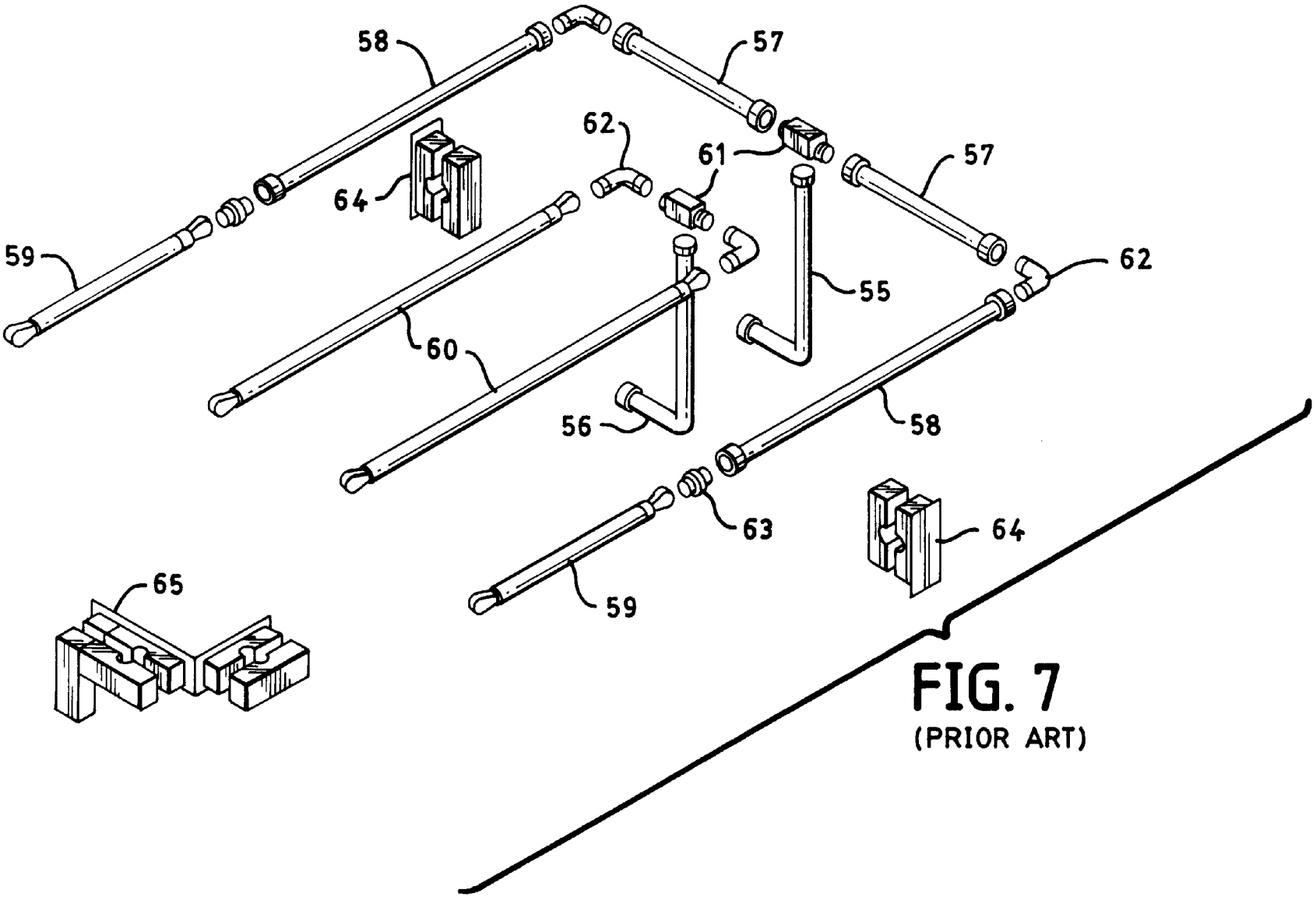
FIG. 7 (PRIOR ART)
FIG. 7 displays the hydraulic manifolding for the grinder of FIG. 1.
Figure 8:
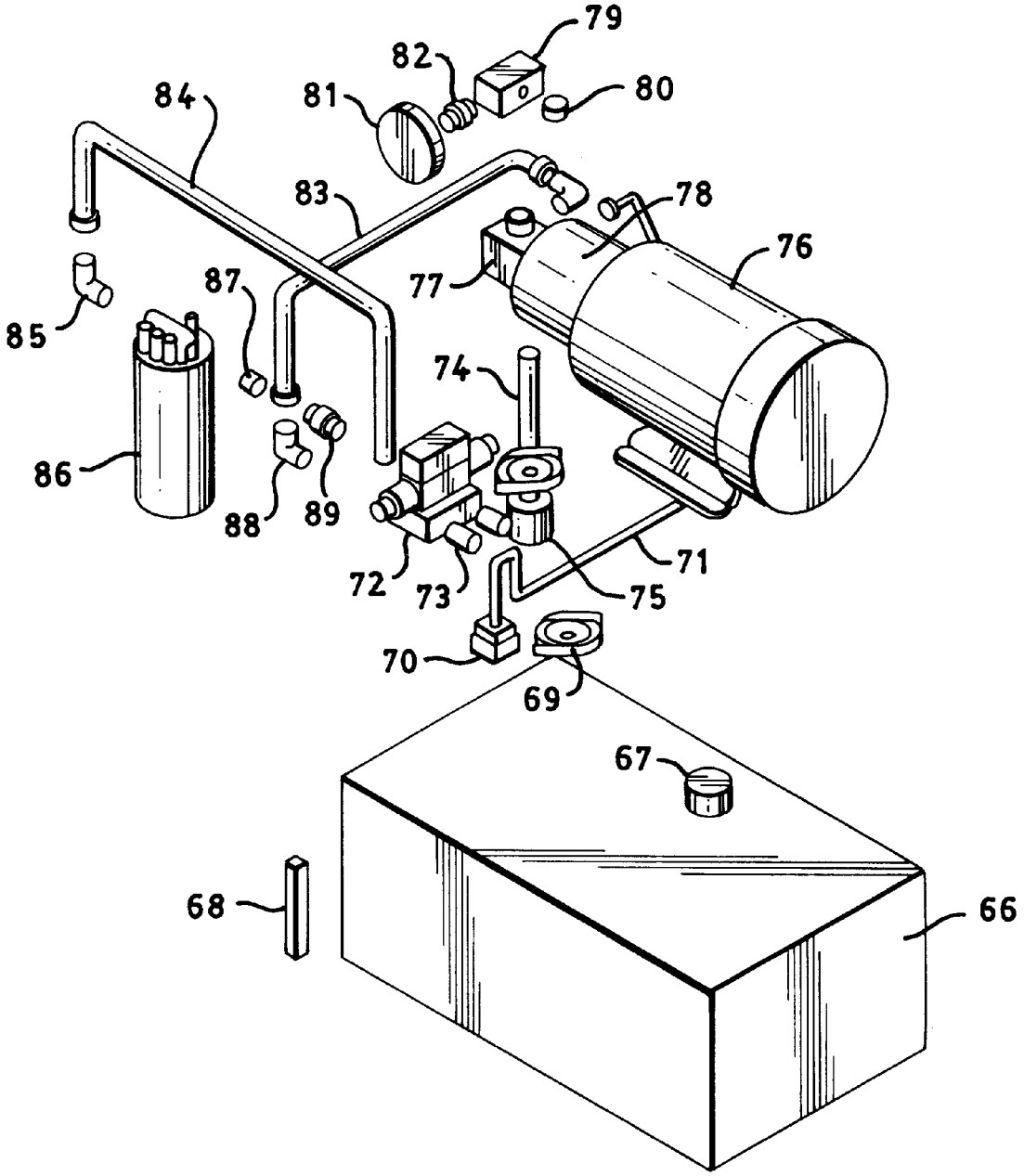
FIG. 8 (PRIOR ART)
FIG. 8 displays the hydraulic power unit for the grinder of FIG. 1.

With reference to FIGS. 5 and 6, housing 90 contains a pair of opposed horizontal slots 91 which receive the guide rails 29 therein. It can be seen that slots 91 transverse nearly the horizontal length of housing 90. This is necessary because ram plate 33 is received in guide rails 29 and moves horizontally as controlled by the hydraulic system, shown primarily in FIGS. 7–9. The ram must traverse this length because it must be away from the rotor 2 to permit material to be ground to be placed in the ram compartment and then it must travel most of the length of the housing to push the material to be ground into the rotor. These slots 91, having the plastic rails 29 therein, are a weak point of the grinder, and, the present invention eliminates them.

Figure 9:
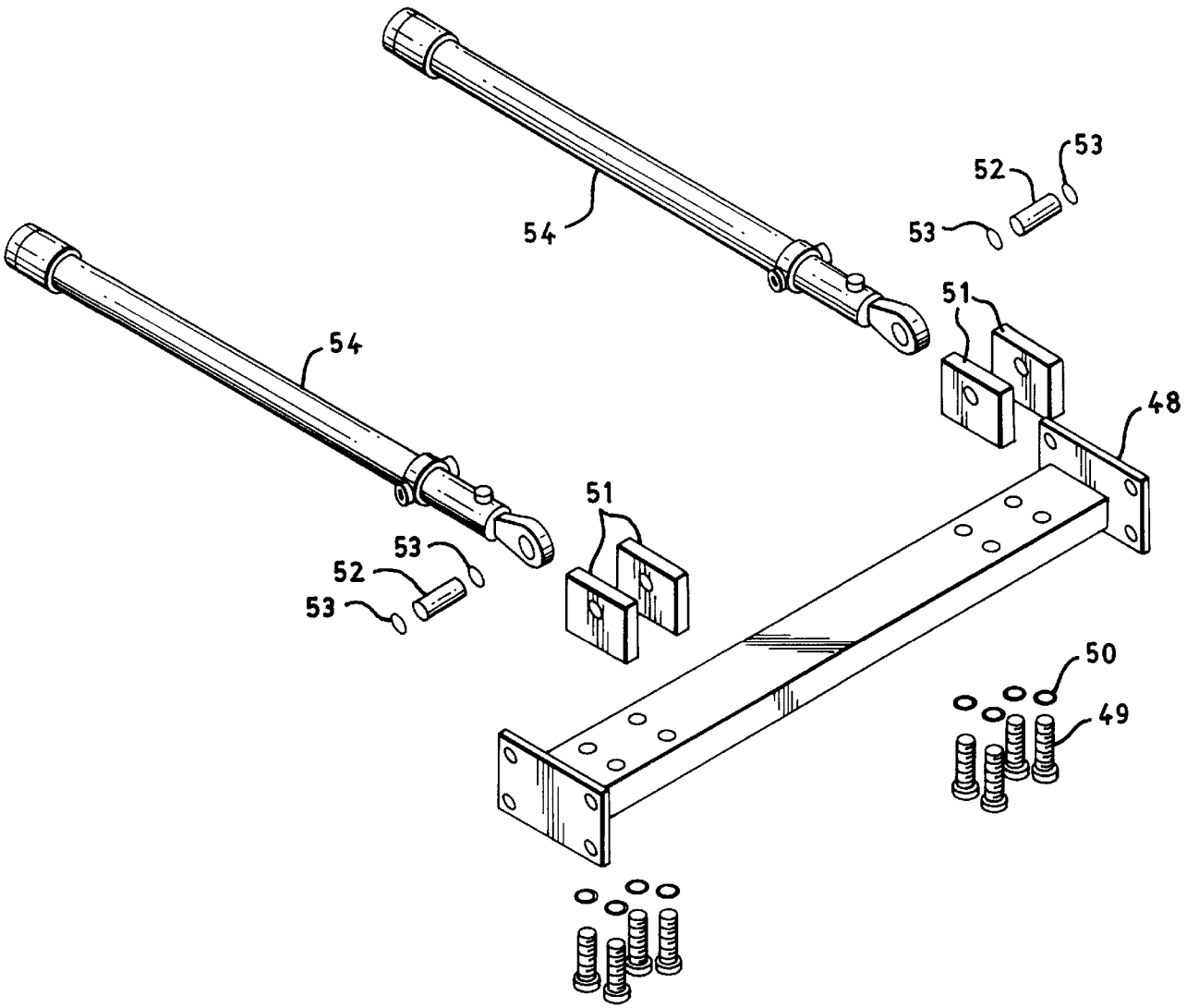
FIG. 9 (PRIOR ART)
FIG. 9 displays the hydraulic cylinder and associated hardware for the grinder of FIG. 1.
Figure 14:
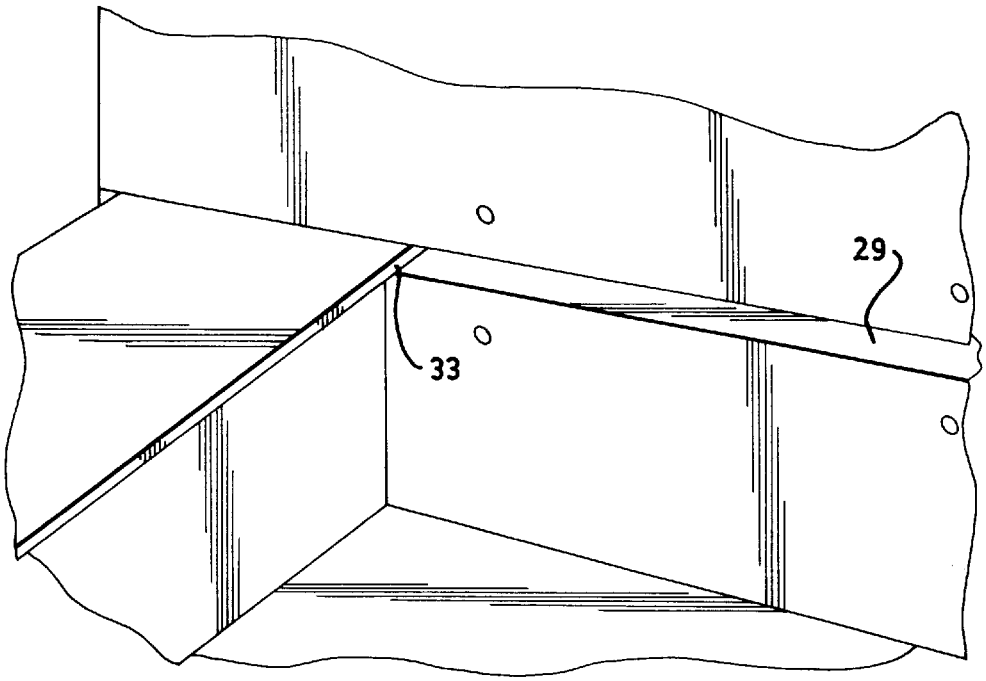
FIG. 14 (PRIOR ART)
FIG. 14 is a perspective view of a prior art ram assembly showing the ram top plate being received in one of the grooves.

As is seen in FIG. 9, a pair of hydraulic cylinders 54 are used to move the ram. The pistons in the cylinders are attached to the ram on its underneath side, the cylinders pointing away from the rotor. Hydraulic cross bar 48 is attached across the housing and is connected to the non-piston ends of the cylinders. This bar 48 provides an anchor for the cylinders so that the ram is pushed away from the bar or pulled toward it. The dual cylinder system provides stability for the ram. However, as the guide rails are exposed inside the ram compartment, material can interfere with the normal movement of the ram plate 33 in the rails 29. FIG. 14 provides a view inside the ram compartment to show the ram plate 33 received in the rail 29.

Figure 15:
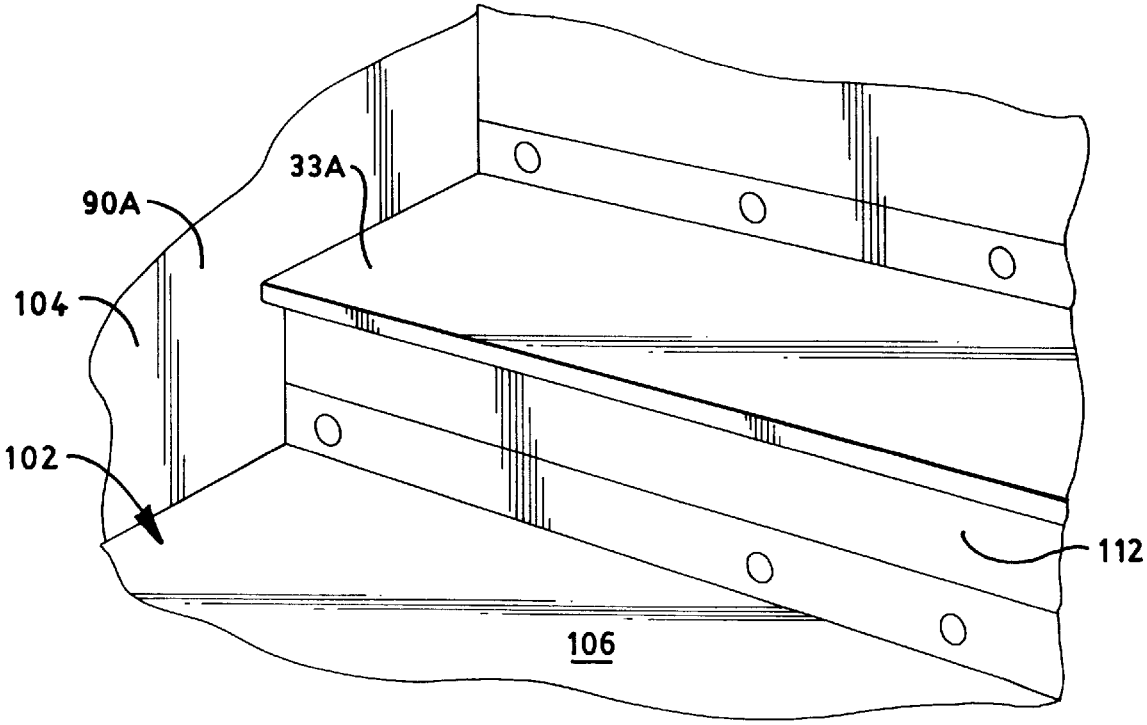
FIG. 15 is a perspective view of the ram of the instant invention showing the ram in the ram compartment.

FIGS. 10–13 and 15–16 show rotary grinder 100 having the improved ram assembly 33A of the instant invention. FIG. 15 shows the ram 33A in the ram compartment 102 and positioned partway between its two end limits, that is, the ram 33A has moved partway toward the rotor 2 from its furthest position from the rotor 2. The vertical walls 104 in the ram compartment 102 are smooth. There are no guide rails 29 for the ram 33A. This provides for increased strength of the housing 90A and eliminates the "trap" (the guide rails 29) which could receive material and interfere with the horizontal movement of the ram 33A.

Figure 12:
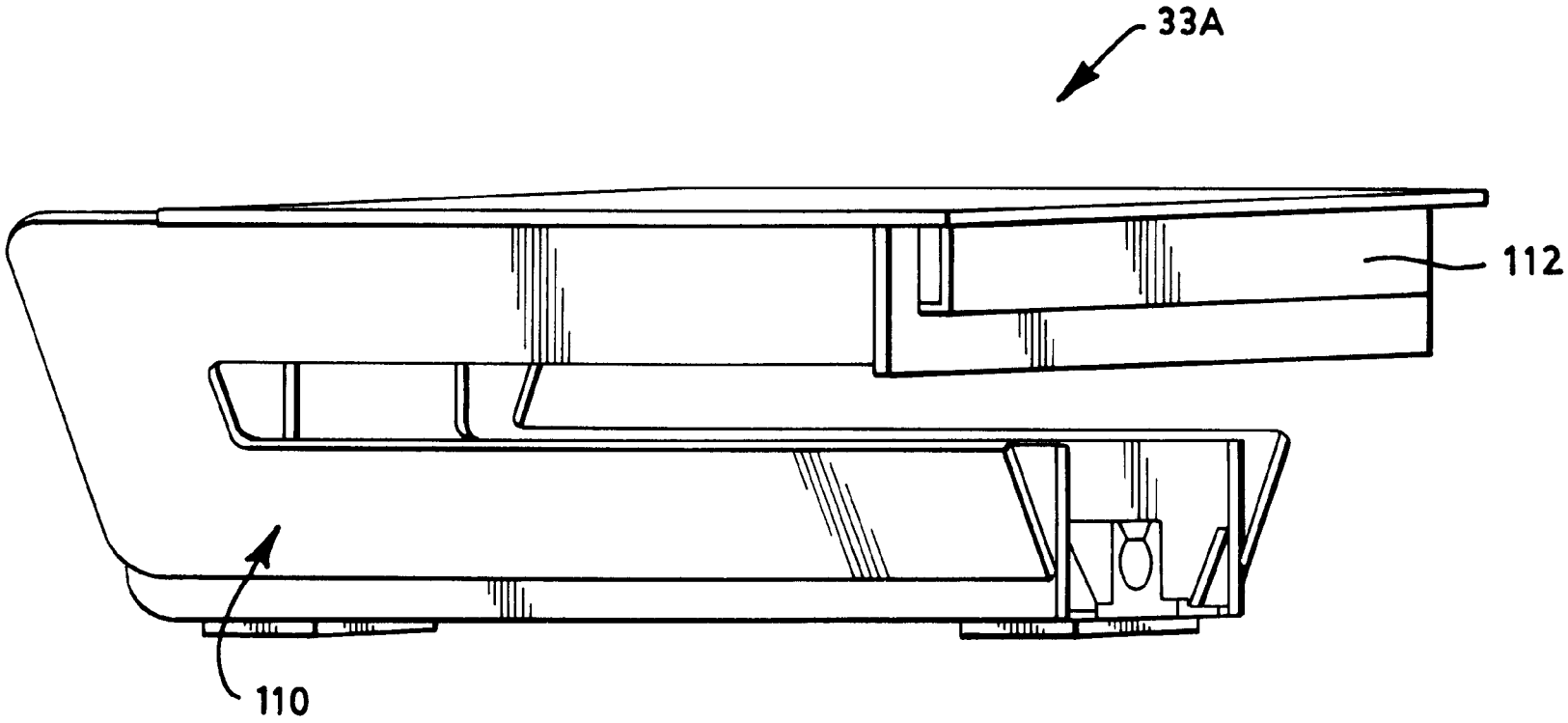
FIG. 12 is a perspective view of the ram assembly of the present invention to show the U-shaped support plates.
Figure 13:
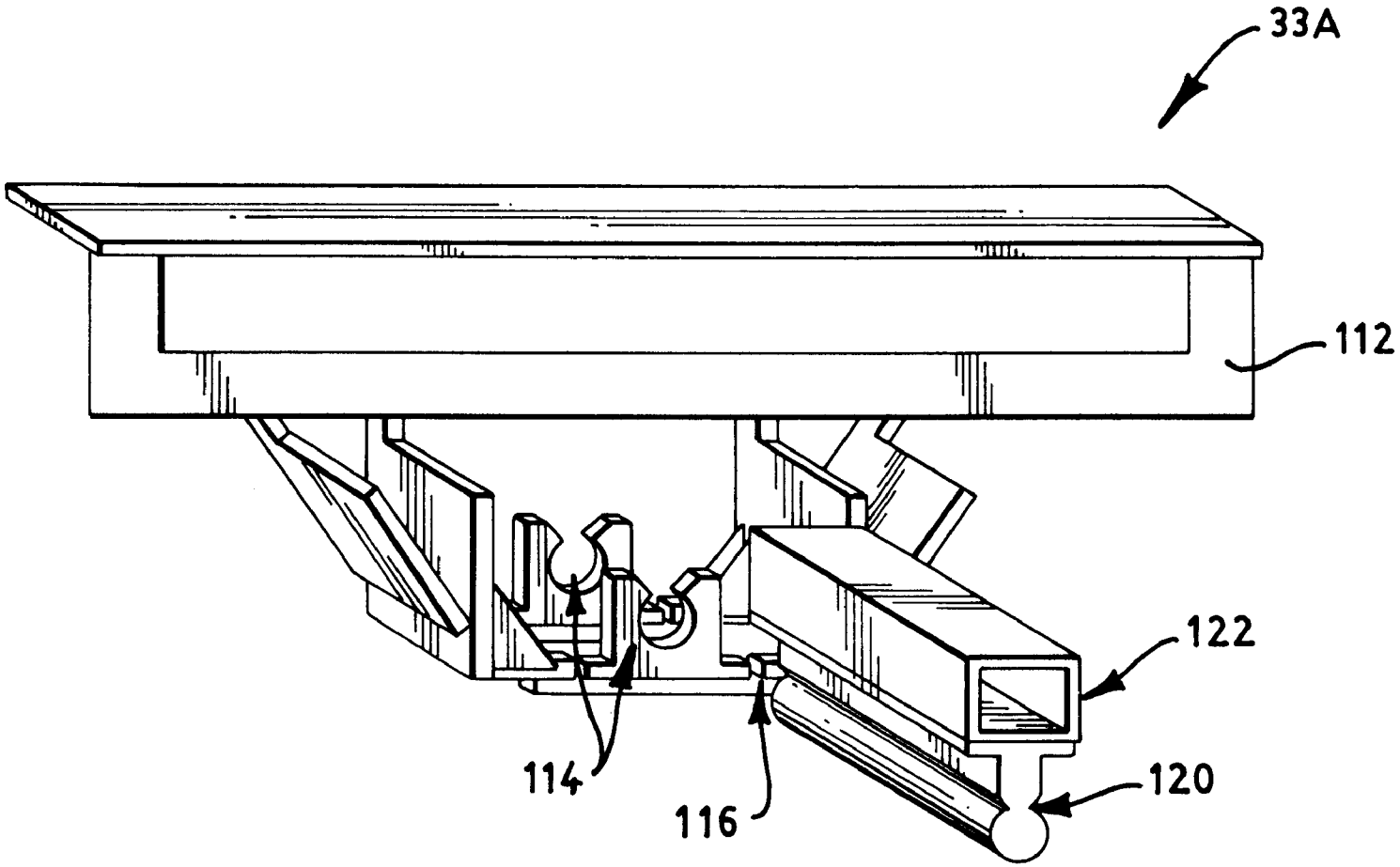
FIG. 13 is another perspective view of the ram assembly of the present invention and further showing the relationship to the linear bearing mounting base and rod.
Figure 16:
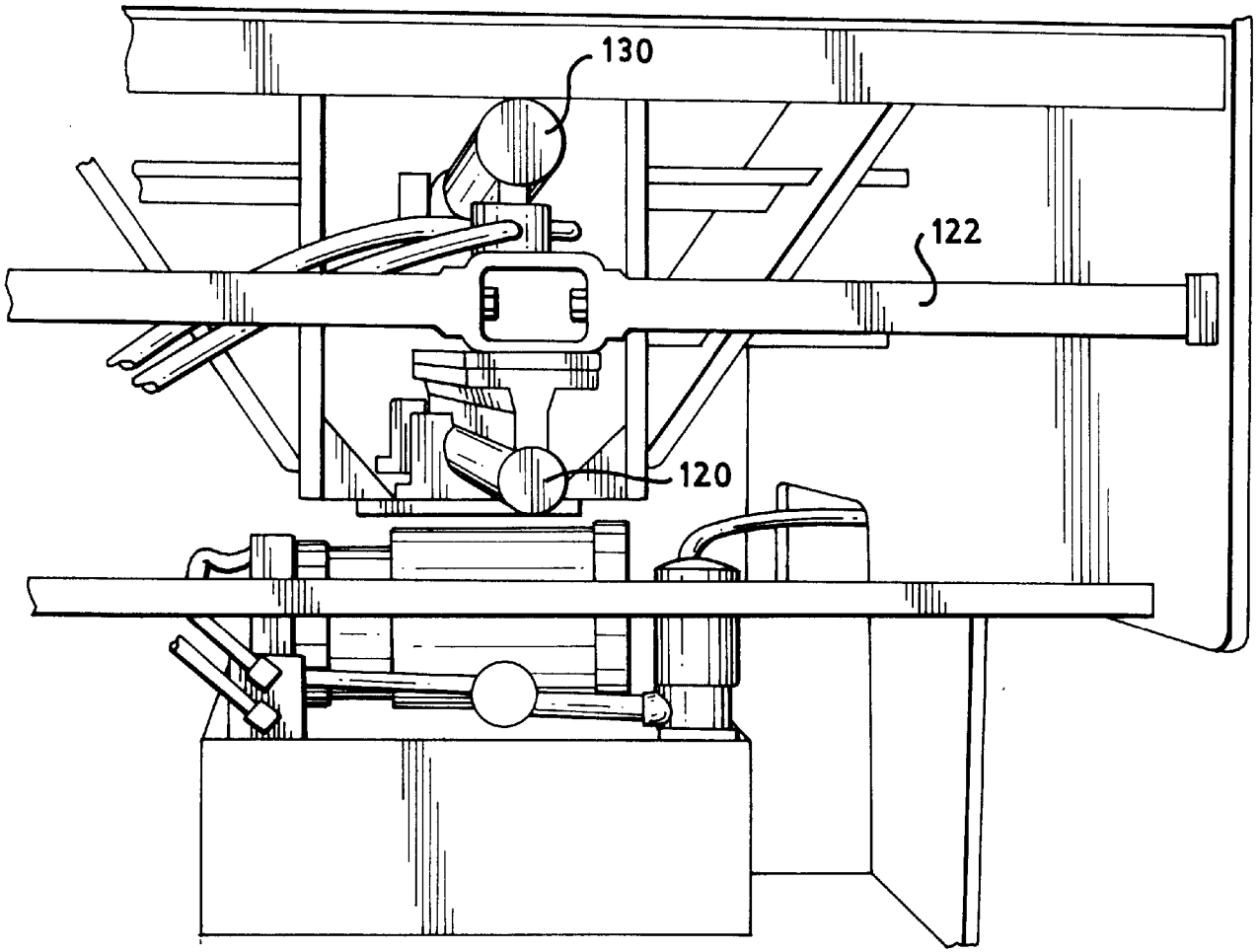
FIG. 16 is an end perspective view of the ram assembly and its support structure.
Figure 17:
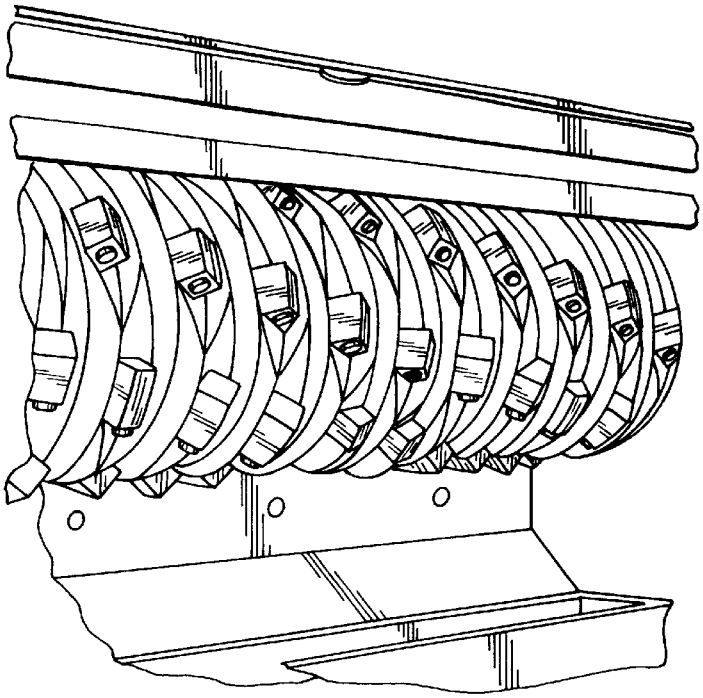
FIG. 17 (PRIOR ART)
FIG. 17 is a prior art rotor having a plurality of cutters attached thereon.

FIG. 12 shows the ram assembly 33A and its U-shaped support plates 110. The ram portion 112 on the top moves within the ram compartment 102 and pushes material toward the rotor 2. The support plates 110 on the bottom portion will move underneath the ram compartment 102 along a rod 120, as controlled by the system hydraulics. The ram 33A can move from the left to right as permitted by the bottom portion of the "U", or the portion connecting the ram top portion 112 and the bottom portion, that being the portion at the left side of FIG. 12. In FIG. 13, the ram assembly 33A has been rotated about 90°. In this Figure, the ram top portion 112 shown is the portion which pushes the material to be ground. The support plates 116 underneath the ram top portion 112 are shown having two spaced apart linear bearings 114. A linear bearing mounting base 122 having a linear bearing rod 120 below it is attached in the housing 90A underneath the ram compartment 102, as shown in FIG. 16. A hydraulic cylinder 130 is mounted above the linear bearing mounting base 122. The piston 132 is attached to the ram 33A and hydraulically controlled.

Figure 10:
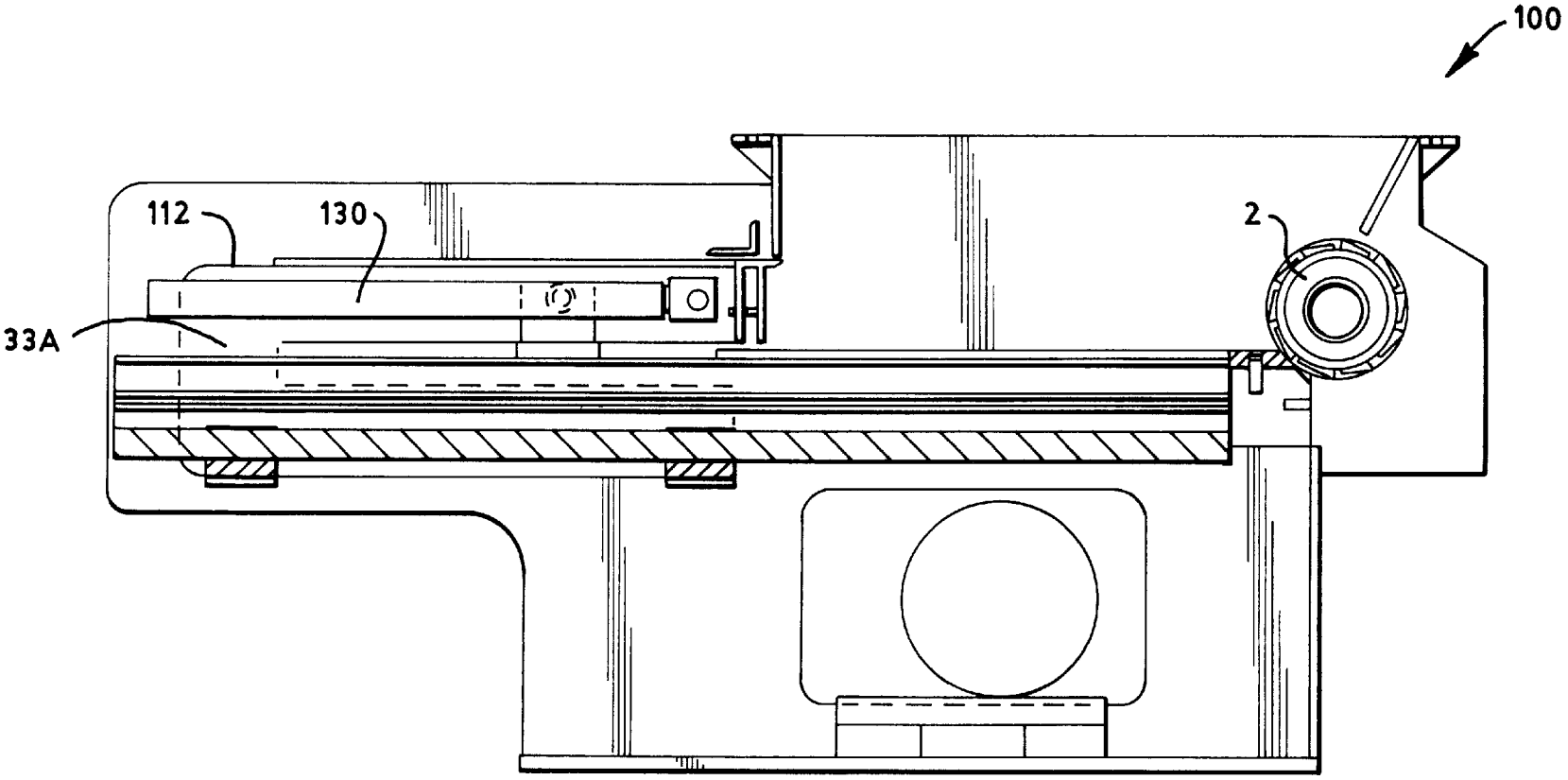
FIG. 10 is a lengthwise cross-section view of the improved ram system of the present invention showing the ram at its most distant point from the rotor (ram back or open)
Figure 11:
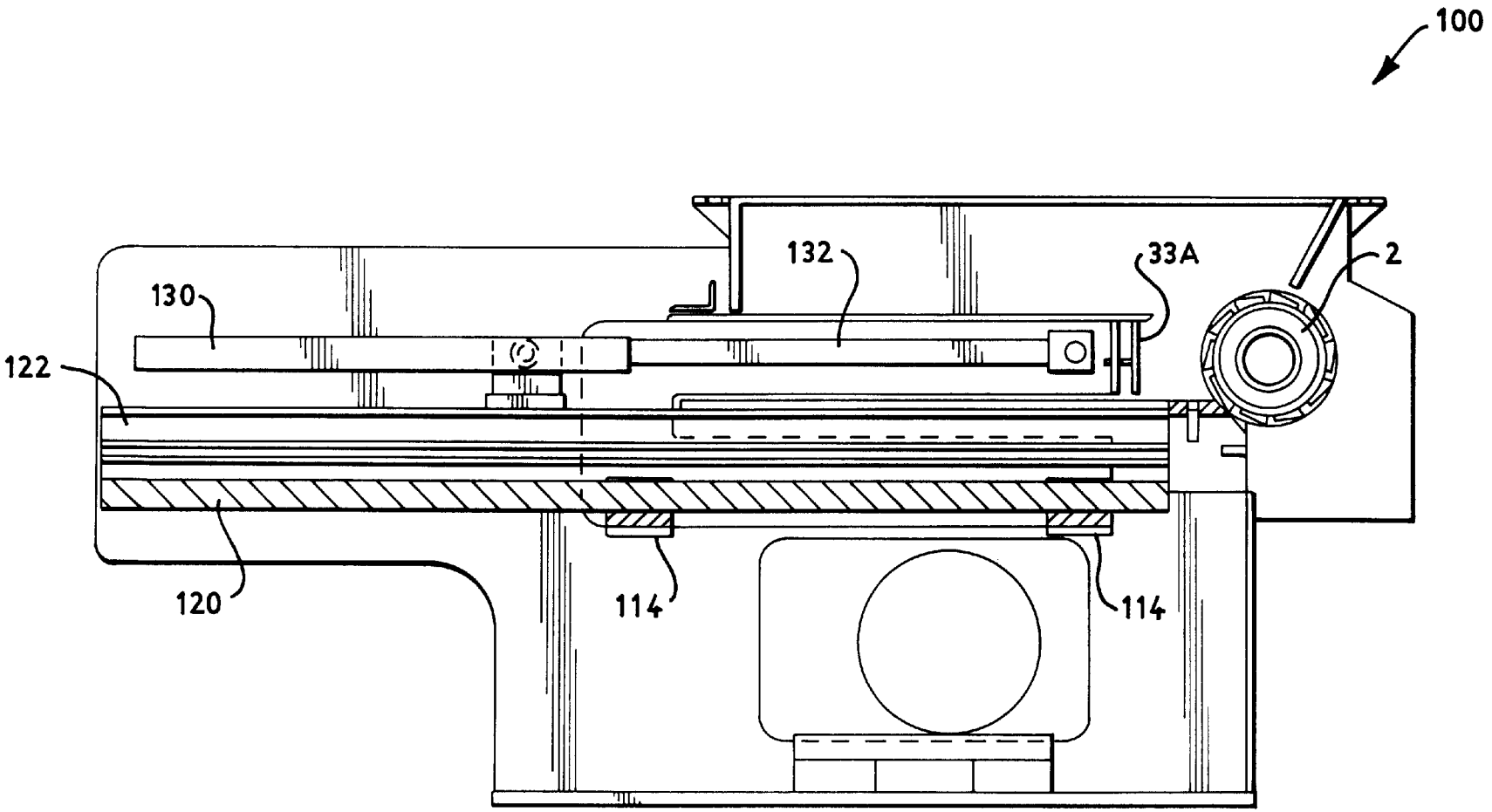
FIG. 11 is a lengthwise cross-section view of the improved ram system of the present invention showing the ram at its closest point to the rotor (ram forward or closed)

FIGS. 10 and 11 demonstrate the movement of the ram assembly 33A above and below the ram compartment 102. In FIG. 10 the ram 33A is at its furthest point from the rotor 2, the piston 132 received within the hydraulic cylinder 130. In FIG. 11, as has been permitted by the U-shaped ram support, the ram 33A has been moved to the right toward the rotor 2. The piston 132 has extended from the hydraulic cylinder 130 to power the ram 33A to the right. The pair of spaced linear bearings 114 have moved along the fixed linear bearing rod 120. This configuration provides support to the ram 33A to prevent it from moving off the horizontal in an upward or downward direction and to prevent the ram 33A from twisting in the vertical due to material on one side of the ram compartment 102 or the other. The floor 106 of the ram compartment 102 additionally prevents downward movement of the ram 33A especially when impact loaded from the top. FIGS. 10 and 11 demonstrate how the U-shaped ram supports permit a more dimensionally compact grinder.

The rotor 2 and a typical cutter 2B and cutter insert assembly 2A are generally shown in FIG. 5. For the 52" wide Model RG-52 shown, 37 such cutters and cutter insert assemblies are employed. If the rotor was cross-sectioned through its axis, the edges would have a serrated appearance. That is, moving horizontally along the rotor, there are a plurality of alternating peaks and valleys. Each peak and each valley lies in its own vertical plane, transverse the rotor center axis, and the transition from each peak to valley is a linear transition. At desired locations about the rotor are positions to mount the cutters. This is known to those of skill in the art.

Figure 18:
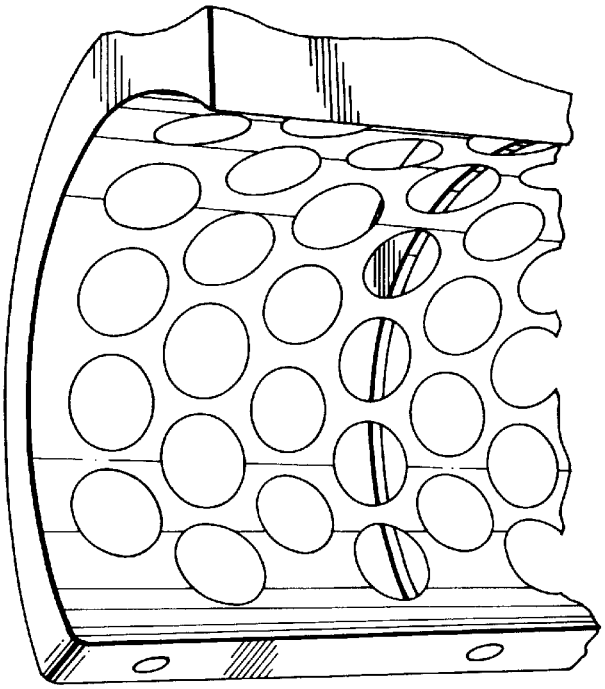
FIG. 18 (PRIOR ART)
FIG. 18 shows the portion of the inside curved surface of a prior art screen.

A prior art rotor screen 45 is shown in FIGS. 5 and 18. Screen 45 can have any size openings therein, depending on the material to be ground. To grind to a small size, the screen will have smaller diameter openings and more of them. Only material ground to the proper size or smaller will pass through the screen and exit the grinder system. In general, prior art screens are placed a distance from the rotor/cutter assembly. The screens are arced and are generally smooth or flat on their side facing the rotor/cutter assembly. While grinding wood and certain types of plastic, the prior art screen and rotor/cutter assembly relationship has proven satisfactory. However, with certain plastics, such as for example, a soft and fluffy plastic, the plastic may not pass completely through the screen openings, but rather may hang up in the screen openings and interfere with subsequent ground material. This can jam up the screen and cause the grinder to have to be shut down to clear the plastic from the screen. The screen of the present invention solves this problem.

Figure 19:
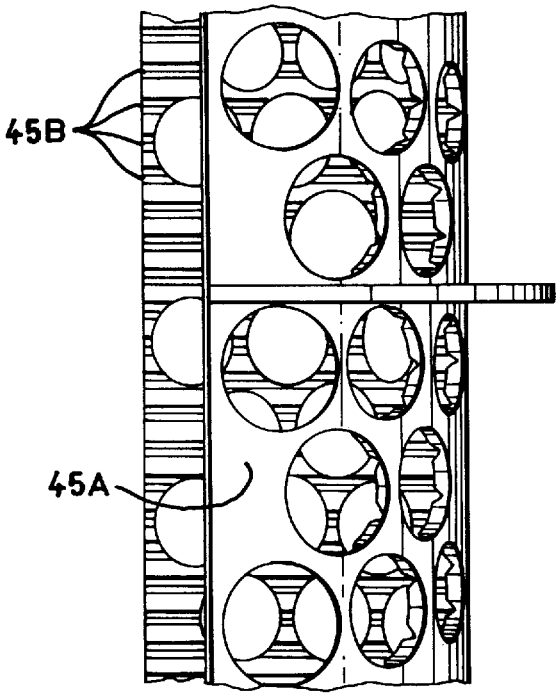
FIG. 19 shows the screen with cutter receiving grooves on its inside curved surface.
Figure 20:
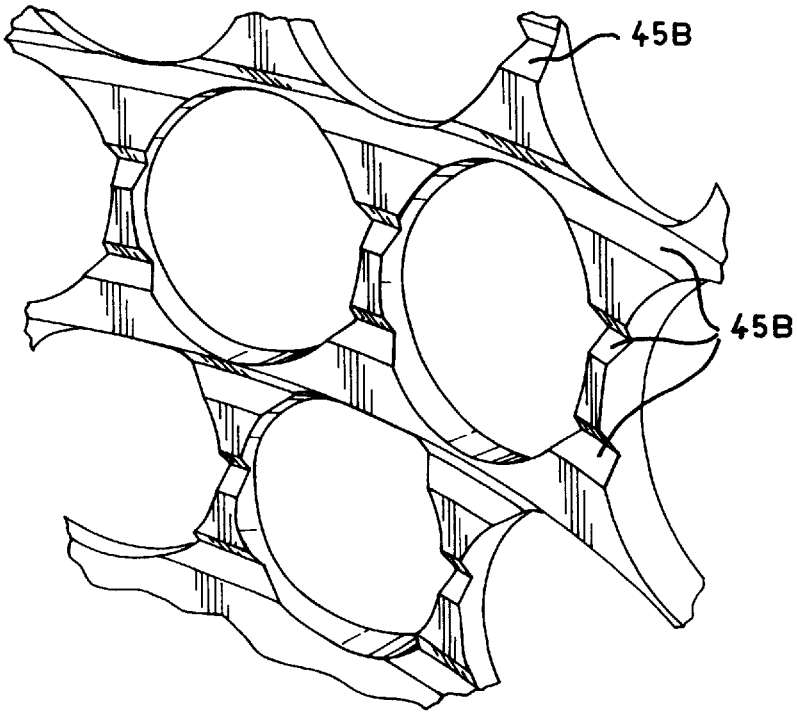
FIG. 20 is an enlarged view of the screen grooves for the screen of FIG. 19.
Figure 21:
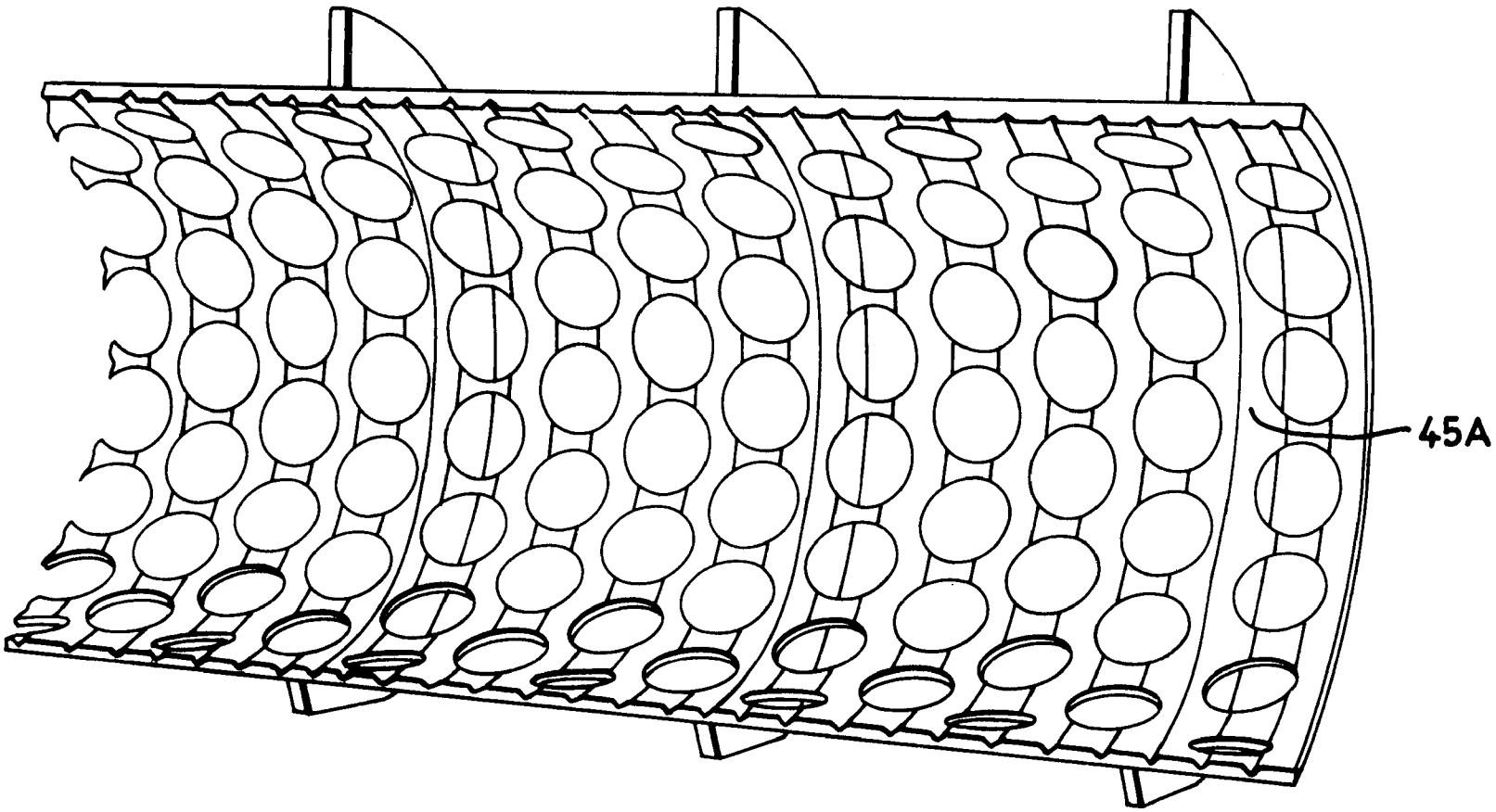
FIG. 21 shows the inside curved surface of the screen of FIG. 19.
Figure 22:
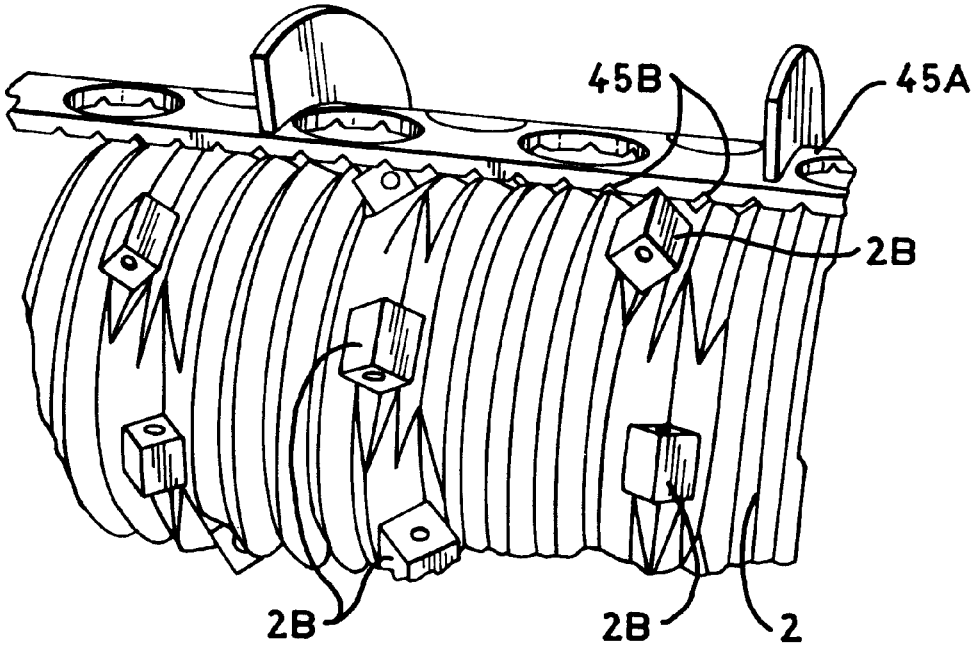
FIG. 22 provides a perspective of the spaced relationship of the screen of FIG. 19 and the rotor/cutter assembly.
Figure 23:
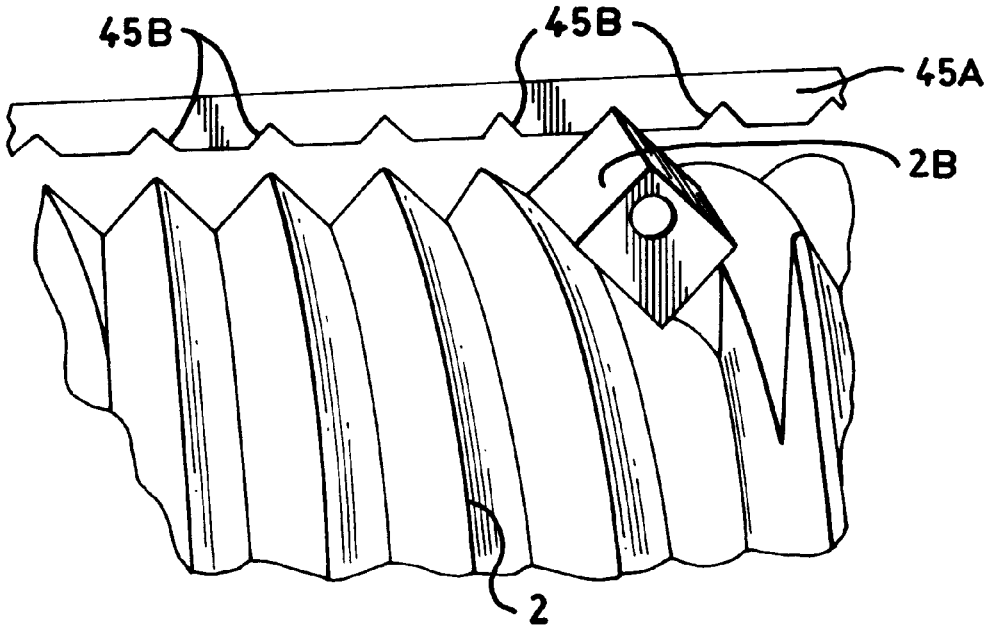
FIG. 23 provides an end perspective view of the spaced relationship of the screen of FIG. 19 and the rotor/cutter assembly.
Figure 24:
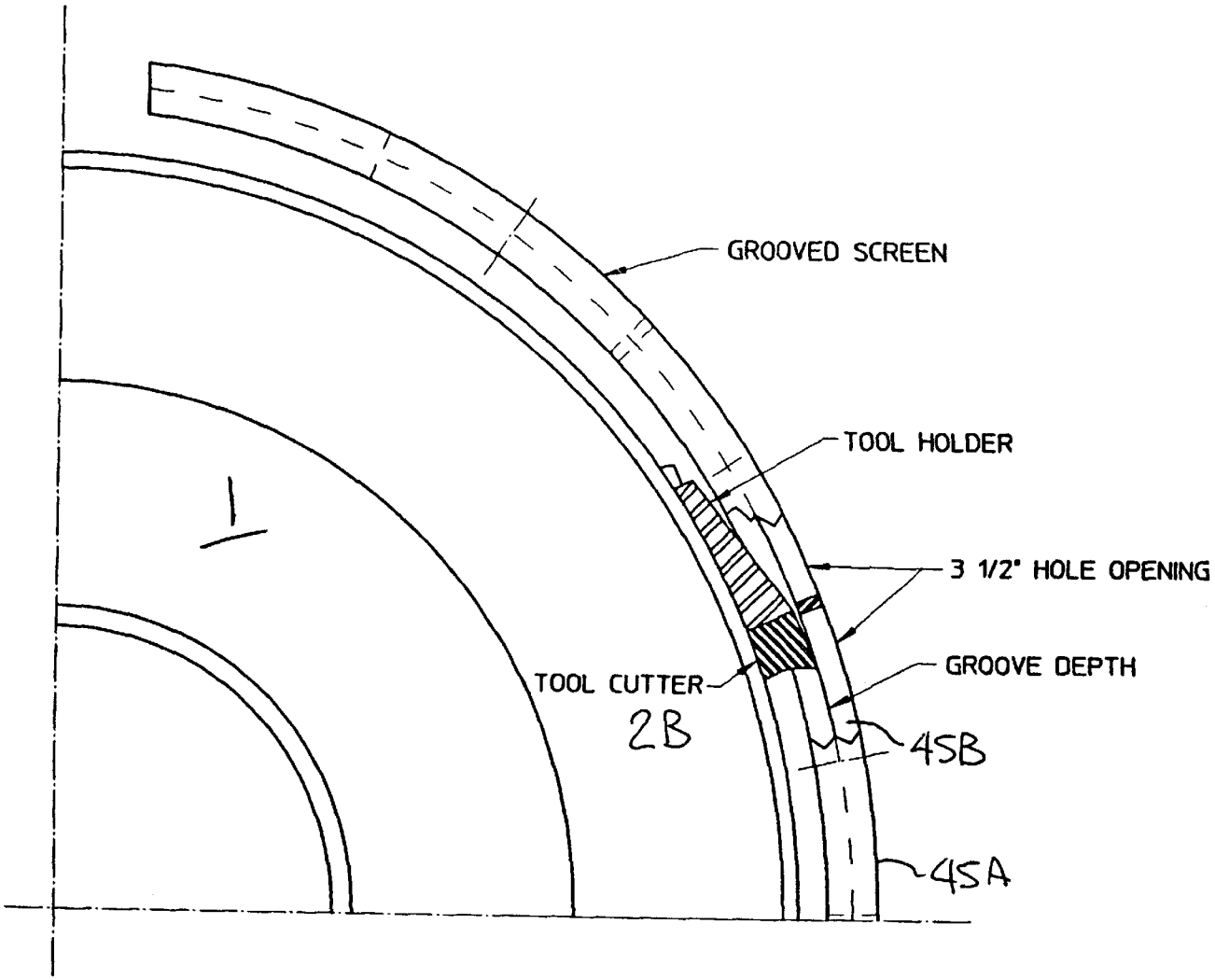
FIG. 24 is a cross-section view to demonstrate how the cutter is received within a groove on the screen to prevent the openings in the screen from becoming clogged with ground material.

With references to FIGS. 19–24, the screen 45A of the present invention is shown. FIG. 21 shows the inside surface of the screen 45A which would face the rotor 2. FIG. 19 shows the outer surface of the screen 45A and a portion of the inside (on the left side of the figure) which shows the plurality of parallel screen grooves 45B. When the screen is in position in the grinder, each groove will lie in a vertical plane. FIG. 20 shows a portion of the inside of the screen 45A in greater detail to show the grooves 45B. Each groove 45B is designed to receive one of the cutters 2B attached to rotor 1 as the rotor rotates. For the screen of FIG. 20, it can be seen that three different cutters will pass along one set of vertical openings. The rotor/cutter assembly employed is not changed from the prior art. However, in addition to the screen grooves 45B, in the present invention, the screen must be placed closer to the rotor/cutter assembly. In general, there should be about ⅛" clearance between the cutter and the screen groove which receives it. This spaced relationship is shown in FIGS. 22–24. This "closeness" permits the cutter passing through a groove 45B to clean or remove any material caught up in the screen openings through which the groove passes. This results in less equipment shut down to remove material caught in the screen.

The foregoing detailed description is given primarily for clearness of understanding and no unnecessary limitations are to be understood therefrom for modifications will become obvious to those skilled in the art upon reading this disclosure and may be made without departing from the spirit of the invention.

We claim:

1. A grinder, comprising:

a. a ram compartment, said ram compartment having a rotor toward a first end and a ram receiving opening toward a second end, said first end being opposed to said second end;

b. a ram, said ram having a top portion, a bottom portion, and a portion connecting said top and said bottom portions toward one end thereof, said top portion and said bottom portion having a spaced distance therebetween, said bottom portion being at a location underneath said top portion, said ram bottom portion having a plurality of linear bearings connected thereto;

c. said grinder having a portion vertically below said ram compartment, said portion having a horizontal mounting base therein, said horizontal mounting base having a hydraulic cylinder connected thereabove, said hydraulic cylinder having a piston, said horizontal mounting base having a linear bearing rod connected thereunder;

d. said ram top portion received by said ram receiving opening, said plurality of linear bearings received by said linear bearing rod, said piston connected to said ram; and, e. said piston being operable to move said ram from said second end toward said first end and reverse.

2. The grinder of claim 1, where said plurality of linear bearings comprises two linear bearings and where, as said piston operably moves said ram, said two linear bearings operably move along said linear bearing rod.

3. The grinder of claim 1, where said ram compartment contains no ram guide rails.

4. The grinder of claim 1, where said ram compartment has opposed sides, said opposed sides containing no ram guide rails.

5. The grinder of claim 1, where said plurality of linear bearings received by said linear bearing rod act to prevent said ram from vertical movement.

6. The grinder of claim 5, where said plurality of linear bearings received by said linear bearing rod act to prevent said ram from vertical side torque when said ram is moving in a horizontal direction from said second end toward said first end.

7. The grinder of claim 1, further comprising a rotor screen external to said ram compartment, said rotor screen having a plurality of openings therethrough.

8. The grinder of claim 7, where said rotor has a circular cross-section and has a plurality of cutters thereon, each of said cutters having a portion extending away from said rotor; where said rotor screen has a plurality of screen grooves on a side which faces said rotor, one of said screen grooves at least partially receiving said portion extending away from one of said cutters.

9. The grinder of claim 8, where said plurality of screen grooves intersect at least some of said plurality of openings.

10. The grinder of claim 9, where as said each of said cutters having a portion extending away from said rotor at least partially received by one of said screen grooves prevents any of said plurality of openings it intersects from becoming clogged with material being ground.

11. The grinder of claim 1, where said ram has a general U-shape.

12. In a grinder having a rotor which has a circular cross-section and has a plurality of cutters thereon, each of said cutters having a portion extending away from said rotor, the improvement which comprises: a rotor screen having a plurality of openings therethrough, said rotor screen being placed in close proximity to said rotor; where said rotor screen has a plurality of screen grooves on a side which faces said rotor and which pass along at least one of said plurality of openings therethrough said rotor screen, and each of said plurality of cutters having its respective portion extending away from said rotor being at least partially received by a related one of said plurality of screen grooves.

13. The grinder of claim 12, where said plurality of screen grooves intersect at least some of said plurality of openings.

14. The grinder of claim 13, where as said each of said cutters having a portion extending away from said rotor at least partially received by one of said screen grooves prevents any of said plurality of openings it intersects from becoming clogged with material being ground.

15. In a grinder having a ram compartment, a rotor which has a circular cross-section and has a plurality of cutters thereon, each of said cutters having a portion extending away from said rotor; a ram which travels in said ram compartment towards said rotor, where said ram forces a material to be ground toward said rotor to engage at least one of said plurality of cutters on said rotor; and a rotor screen positioned external from said ram compartment and after said rotor; the improvement which comprises: said rotor screen having a plurality of openings therethrough, said rotor screen being placed in close proximity to said rotor, where said rotor screen has a plurality of screen grooves on a side which faces said rotor and which pass along at least one of said plurality of openings therethrough said rotor screen, and each of said plurality of cutters having its respective portion extending away from said rotor being at least partially received by a related one of said plurality of screen grooves.

16. The grinder of claim 15, where as said each of said cutters having a portion extending away from said rotor at least partially received by one of said screen grooves prevents any of said plurality of openings it intersects from becoming clogged with said material being ground.

* * * * *